US008186796B2

(12) United States Patent
Yamaguchi et al.

(10) Patent No.: US 8,186,796 B2
(45) Date of Patent: May 29, 2012

(54) ELEMENT SUBSTRATE AND PRINTHEAD

(75) Inventors: Takaaki Yamaguchi, Yokohama (JP); Yoshiyuki Imanaka, Kawasaki (JP); Takuya Hatsui, Tokyo (JP); Souta Takeuchi, Yokohama (JP); Takahiro Matsui, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 12/129,604

(22) Filed: May 29, 2008

(65) Prior Publication Data

US 2008/0297548 A1 Dec. 4, 2008

(30) Foreign Application Priority Data

May 30, 2007 (JP) ..... 2007-143788
May 19, 2008 (JP) ..... 2008-131275

(51) Int. Cl.
*B41J 29/38* (2006.01)

(52) U.S. Cl. ..... 347/17; 347/5; 347/9; 347/10; 347/11; 347/12; 347/18

(58) Field of Classification Search ..... None
See application file for complete search history.

(56) References Cited

U.S. PATENT DOCUMENTS 4,392,992 A 7/1983 Paulson et al.
4,510,178 A 4/1985 Paulson et al.
4,591,821 A 5/1986 Paulson et al.
5,173,717 A 12/1992 Kishida et al.
5,235,346 A * 8/1993 Yeung ..... 347/209
5,357,268 A 10/1994 Kishida et al.
6,287,933 B1 * 9/2001 Iida et al. ..... 438/382
6,471,337 B1 * 10/2002 Inoue ..... 347/57
6,769,762 B2 8/2004 Saito
2006/0092202 A1 * 5/2006 Tamura ..... 347/10
2007/0091131 A1 * 4/2007 Hatsui et al. ..... 347/11
2007/0153036 A1 * 7/2007 Akama et al. ..... 347/9
2007/0211095 A1 * 9/2007 Hirayama ..... 347/14

FOREIGN PATENT DOCUMENTS

JP 05-031899 A 2/1993

* cited by examiner

*Primary Examiner* — Matthew Luu
*Assistant Examiner* — Justin Seo
(74) *Attorney, Agent, or Firm* — Canon U.S.A., Inc. IP Division

(57) ABSTRACT

An element substrate capable of obtaining a high-quality printed image for a long period. The element substrate has a plurality of heaters, driving elements each of which is provided in correspondence with each of the plurality of heaters to selectively drive the plurality of heaters, an input terminal to receive a driving mode selection signal, and a block selection circuit which time-divisionally drives, in blocks of different timings, heaters in each of a plurality of groups each including a predetermined number of heaters and driving elements. The element substrate includes a logic circuit which time-divisionally drives the heaters in the group when the selection signal input from the input terminal is a signal for selecting a first driving mode, and simultaneously drives all heaters in the group when the selection signal is a signal for selecting a second driving mode.

5 Claims, 17 Drawing Sheets

ELEMENT SUBSTRATE AND PRINTHEAD

BACKGROUND OF THE INVENTION

1. Field of the Invention

The present invention relates to an element substrate on which a plurality of printing elements are arranged while being divided into groups each including a predetermined number of printing elements, print data is supplied to each group, and adjacent printing elements in each group are not simultaneously driven in printing. The present invention also relates to a printhead and a printing apparatus having the element substrate.

2. Description of the Related Art

A printhead, which discharges ink droplets in a direction perpendicular to a surface and has heaters for generating a thermal energy, is known as one of ink jet printheads which use heat as an energy for ink droplet discharge. In a printhead of this type, generally, ink to be discharged is supplied from the reverse side of the element substrate having the heaters via ink supply ports extending through the element substrate.

U.S. Pat. No. 5,173,717 discloses a printhead having a plurality of printing elements arrayed in a line. In a printhead of this type, the plurality of printing elements is divided into blocks. Several driving integrated circuits are arranged on a single element substrate to simultaneously drive the printing elements in each block. Image data is arranged in correspondence with each printing element, thereby executing arbitrary printing on a print medium.

Such printhead widely uses a driving method of dividing printing elements into a plurality of blocks, as described above, and sequentially driving the blocks for the purpose of, for example, reducing the maximum necessary power for driving the printing elements. U.S. Pat. No. 5,357,268 is known as a prior-art technique of divisional block driving.

Particularly, when one printing element is continuously driven, the print density may change due to accumulated heat. The printing element is also affected by the heat of the heater of an adjacent printing element.

When adjacent printing elements are driven simultaneously, the pressure generated upon ink discharge causes crosstalk between the fluid channels of the printing elements. This crosstalk may change the print density. Hence, after driving the printing elements, a quiescent time is preferably inserted to avoid the crosstalk.

As a technique of preventing the above-described problems, distributed driving is known, which distributes simultaneously drivable printing elements in the direction of a printing element array. According to the distributed driving, adjacent printing elements are never driven simultaneously. It is therefore possible to eliminate the influence of adjacent printing elements by inserting a quiescent time.

On the other hand, there has been provided a method of obtaining high image quality, in which the amount of discharge per dot is decreased by reducing the size of a heater included in each printing element. That is, the image quality is improved by reducing the dot size. To increase the print speed, the driving frequency is raised by driving while using a pulse which is shorter than before. However, to drive a smaller size heater having for higher image quality at a higher frequency, as described above, the sheet resistance value must be large.

The relationships between various driving conditions for different heater sizes as shown in FIG. 13A will briefly be described. FIG. 13B shows the changes in the sheet resistance value (Ω/□) and the current value (A) with respect to the driving pulse width (μS) in a heater having a large size (A) and that having a small size (B). FIG. 13C shows the relationships between the sheet resistance value (Ω/□), the current value (A), and the driving voltage (V) in the heater having a large size (A) and that having a small size (B).

As is apparent from the relationships between the driving conditions and the heater sizes in FIGS. 13B and 13C, to drive the small heater under the same conditions as those for the large heater, the sheet resistance value needs to be large. When the heater is driven under a large sheet resistance value and a high driving voltage, the consumed current value becomes small. Since the energy consumption in the resistor portion except the heater decreases, energy saving can be achieved. This effect is particularly large in a printhead including a plurality of heaters.

U.S. Pat. No. 6,769,762 discloses a heater formed from a thin film of $Ta_xSi_yN_z$ (the ratio of the numbers of atoms is x:y:z=20 to 80:3 to 25:10 to 60). This arrangement implements a high-resistance heater characteristic capable of coping with a smaller dot size and enables energy saving in a printhead.

The heater used in a printhead must be able to increase the resistance and maintain desired performance. More specifically, the heater in a printhead raises the temperature to 600° C. to 700° C. upon receiving short pulses, generates bubbles in ink, and discharges it. The high temperature state and the room temperature state are repeated at a high frequency. For this reason, if the heater cannot maintain its performance, the resistance value of the heater may change and pose problems in ink discharge.

More specifically, a printhead generally performs constant voltage driving. Hence, when the resistance value decreases, the current that flows to the heater increases, and the overcurrent extremely shortens the life of the heater. To the contrary, when the resistance value increases, the current decreases, and ink discharge may become impossible. Even after the above-described history of use, the resistance value variation of the heater must be at a minimum.

Such a change in the heater performance can be predicted to some extent by evaluating the temperature coefficient of resistance (TCR characteristic) of the material of the heater. As is known, generally, the smaller the TCR characteristic is (zero ideally), the better a heater can maintain its performance. In developing a heater material, it is very important to simultaneously satisfy the high resistance and the performance maintaining. U.S. Pat. No. 6,769,762 describes that a preferable TCR characteristic can be obtained at a resistivity of 2,500 μΩ·cm or less. U.S. Pat. Nos. 4,392,992, 4,510,178, and 4,591,821 disclose CrSiN films as a material for obtaining a high sheet resistance.

Recent techniques of increasing the printed image quality tend to aim at eliminating graininess in effect. For this purpose, the amount of discharge of a droplet is preferably 1 pl or less.

To cause a number of printing elements to discharge ink in an amount of discharge of 1 pl or less at a high driving frequency, it is necessary to stabilize discharge by suppressing temperature rise without lowering the driving voltage. For example, when the driving voltage is 24 V, the pulse width is 1 μs, and the heater size is 17 μm×17 μm, the sheet resistance must be 700Ω/□ or more.

In the above-described TaSiN, a preferable TCR characteristic is obtained at a resistivity of 2,500 μΩ·cm or less, as described in U.S. Pat. No. 6,769,762. That is, to achieve the recently required sheet resistance of 700Ω/□ or more (resistivity of 3,000 μΩ·cm or more) in the above-described TaSiN, the TCR characteristic degrades, and the performance cannot be maintained. When the resistance is raised to maintain the performance, a problem of productivity such as a large resistivity variation rises. It is therefore necessary to find a new material which simultaneously satisfies the higher resistance and the performance maintaining. From the viewpoint of productivity as well, a new material that ensures a sufficient margin to maintain the performance against the variation in the resistivity is required.

U.S. Pat. Nos. 4,392,992, 4,510,178, and 4,591,821 disclose CrSiN films as a material for obtaining a high sheet resistance as described above. However, in these CrSiN films, when a voltage having a pulse width in actual printing is applied about $1.0\times10^4$ (1.E+04) times, the resistance value changes from the initial resistance value, as shown in FIG. 9. In this state, excess power may be applied to the heater in printing, and the heater may break.

For a thermal printer which performs divisional block driving, a thermal ink jet head having a heater heating mode using a lower applied voltage than that in printing to stabilize the driving of heaters is known. In the heater heating mode of Japanese Patent Laid-Open No. H5-31899, all heaters are simultaneously driven at a voltage lower than that in printing, thereby stabilizing the driving of the heaters.

A plurality of print chips, each of which has heaters and is used in an ink jet printhead, is formed on an Si substrate, as shown in FIG. 14A.

The heaters are formed all at once as a thin film on, for example, a 6- or 8-inch Si substrate by, for example, sputtering using a CrSi alloy as a target in a gas mixture atmosphere containing nitrogen gas and argon gas. FIG. 14A shows an example in which the chips are formed on an Si substrate having a size of, for example, 6 inch or 8 inch. A plurality of heaters is built in each chip formed on the substrate. The resistance values of the heaters have an in-plane distribution on the 6- or 8-inch substrate. That is, the resistance values of the heaters are distributed even in a single substrate or a single chip in accordance with the location in the substrate or chip. The heater heating method of Japanese Patent Laid-Open No. H5-31899 stabilizes the heaters by simultaneously driving all heaters. If the variation between the heater resistance values depending on the positions on the Si substrate or the resistance value variation between the plurality of heaters built in a chip is large, it is impossible to execute fine process control according to the heater resistance value variation between the printing element arrays in the chip.

SUMMARY OF THE INVENTION

The present invention is directed to an element substrate and a printhead.

The element substrate is capable of obtaining a high-quality printed image for a long period.

According to one aspect of the present invention, there is provided an element substrate including a plurality of heaters, driving elements each of which is provided in correspondence with each of the plurality of heaters to selectively drive the plurality of heaters, an input terminal to receive a driving mode selection signal, and a block selection circuit which time-divisionally drives, in blocks of different timings, heaters in each of a plurality of groups each including a predetermined number of heaters and driving elements, comprising a logic circuit which time-divisionally drives the heaters in the group when the selection signal input from the input terminal is a signal for selecting a first driving mode, and simultaneously drives all heaters in the group when the selection signal is a signal for selecting a second driving mode.

According to another aspect of the present invention, there is provided a printhead including the aforesaid element substrate.

The invention is particularly advantageous since the heaters are simultaneously driven on a one-per-block basis in printing to reduce the influence of crosstalk or heat from an adjacent heater. On the other hand, in a process of stabilizing the heater resistance value, the heaters are simultaneously driven in each block. For this reason, according to the present invention, even when heaters made of a material capable of obtaining a high sheet resistance are used, it is possible to execute an optimum heater resistance value stabilization process for each area in accordance with the variation in the initial resistance value and obtain high reliability. This enables obtaining a high-quality printed image for a long period. The heater resistance value stabilization process can be done for each area, that is, each block. This makes it possible to execute a fine stabilization process according to the variation between the printing element arrays in a chip.

Further features of the present invention will become apparent from the following description of exemplary embodiments (with reference to the attached drawings).

DESCRIPTION OF THE EMBODIMENTS

The embodiments of the present invention will be described next with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

An "element substrate" in the description indicates not a simple substrate made of a silicon semiconductor but a substrate with elements and wirings.

The expression "on an element substrate" indicates not only "on the surface of an element substrate" but also "inside of an element substrate near its surface". The term "built-in" in the present invention indicates not "simply arrange separate elements on a substrate" but "integrally form and manufacture elements on an element substrate in a semiconductor circuit manufacturing process".

(Ink Jet Printing Apparatus)

Figure 11:
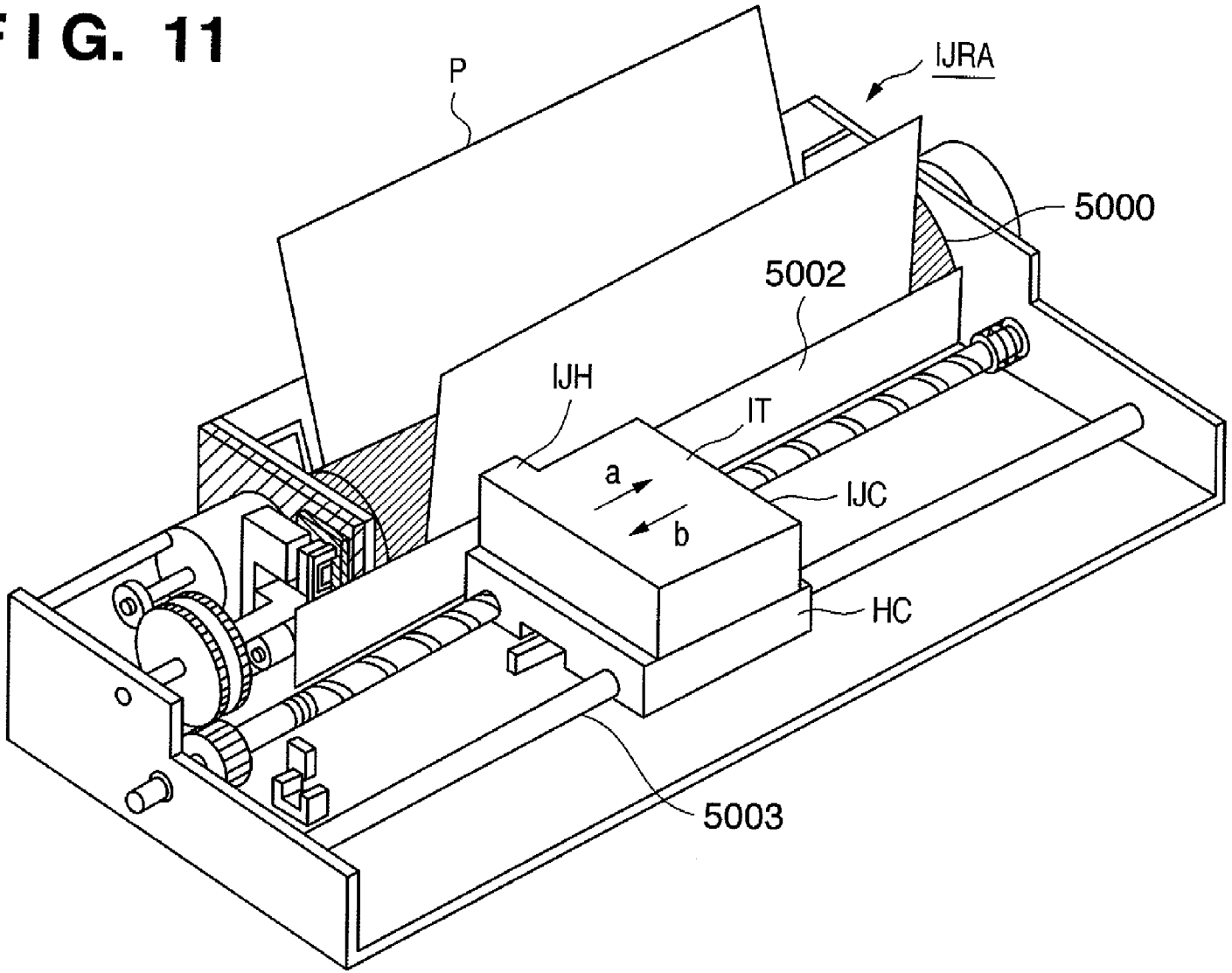
FIG. 11 is a perspective view showing the schematic arrangement of a general ink jet printing apparatus.

FIG. 11 is an outer perspective view showing the schematic arrangement of an ink jet printing apparatus (IJRA) according to a typical embodiment of the present invention.

Referring to FIG. 11, a carriage HC has a pin (not shown) and reciprocally moves in the directions of arrows (a) and (b) while being supported by a guide rail 5003. An integrated ink jet cartridge IJC which incorporates a printhead IJH and an ink tank IT containing ink is mounted on the carriage HC. A paper press plate 5002 presses a print medium P against a platen 5000 in the moving direction of the carriage HC.

A control arrangement for executing print control of the above-described apparatus will be described next.

Figure 12:
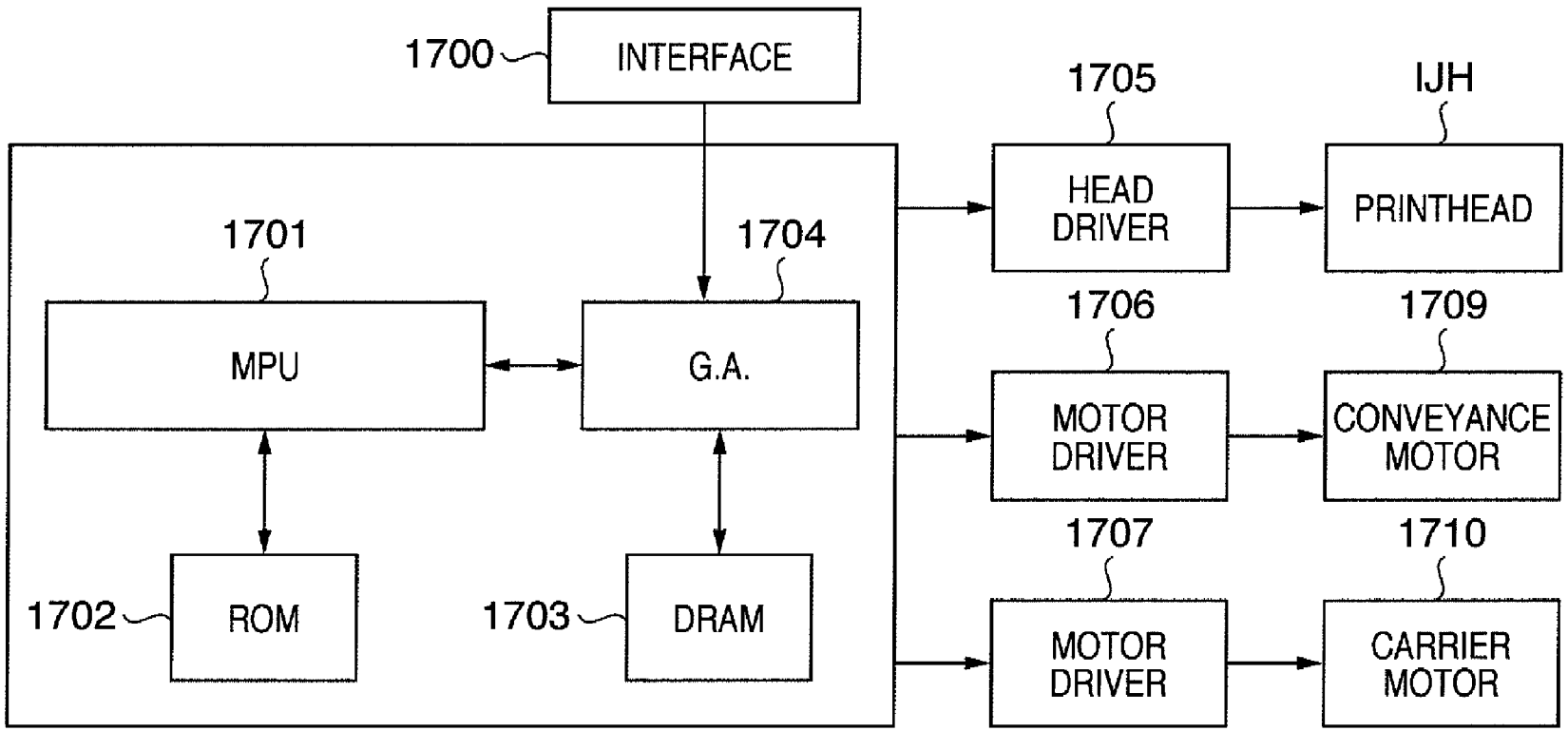
FIG. 12 is a block diagram showing the control arrangement of the general ink jet printing apparatus.
Figure 13A:
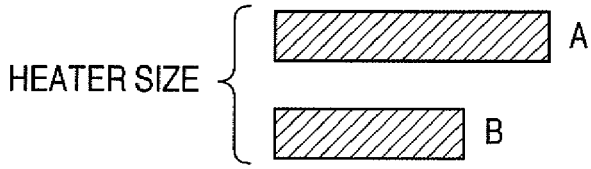
FIG. 13A PRIOR ART
FIG. 13A is a view for explaining the difference in heater size.
Figure 13B:
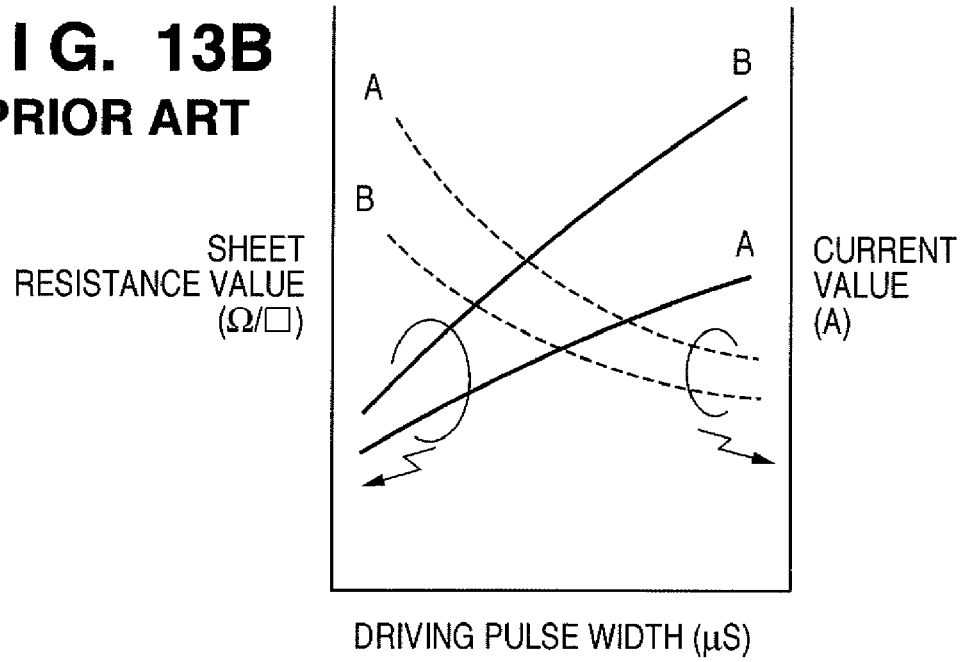
FIG. 13B PRIOR ART
FIG. 13B is a graph for explaining changes in the driving pulse width and sheet resistance value according to the heater size.
Figure 13C:
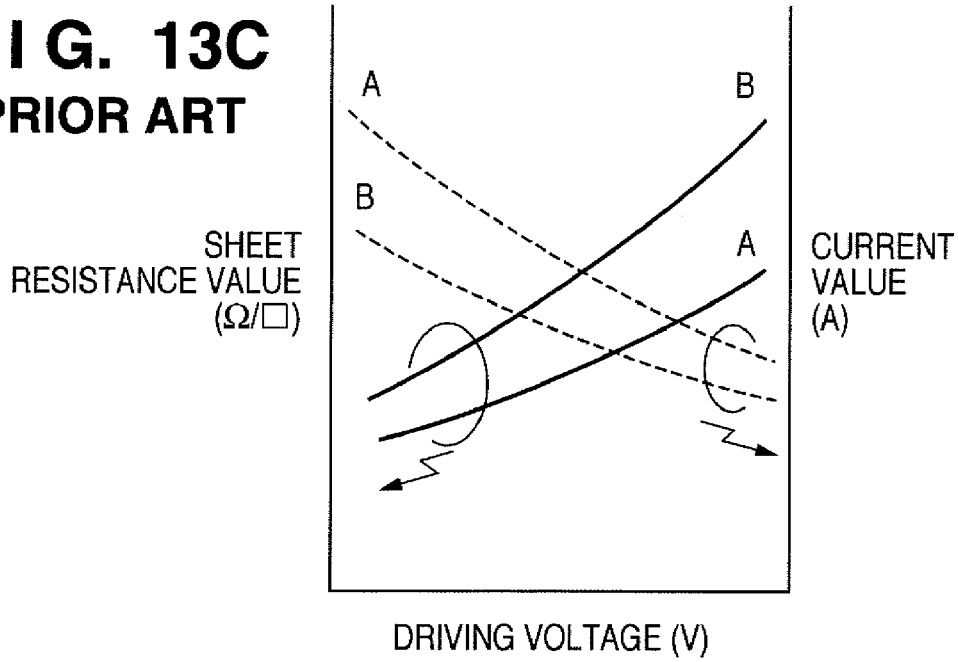
FIG. 13C PRIOR ART
FIG. 13C is a graph for explaining changes in the driving voltage and sheet resistance value according to the heater size.

FIG. 12 is a block diagram showing the arrangement of the control circuit of the ink jet printing apparatus (to be also referred to as a printer hereinafter) IJRA.

Referring to FIG. 12, reference numeral 1700 denotes an interface that inputs a print signal, reference numeral 1701 denotes an MPU, reference numeral 1702 denotes a ROM that stores a control program to be executed by the MPU 1701, and reference numeral 1703 denotes a DRAM that saves various kinds of data (e.g., the print signal and print data to be supplied to the printhead IJH). A gate array (G.A.) 1704 controls print data supply to the printhead IJH and data transfer between the interface 1700, MPU 1701, and RAM 1703. A carrier motor 1710 conveys the printhead. A conveyance motor 1709 conveys a print medium. A head driver 1705 drives the printhead IJH. A motor driver 1706 drives the conveyance motor 1709. A motor driver 1707 drives the carrier motor 1710.

The printing apparatus main body outputs print data, block control data, and a driving mode selection signal (to be described later) to the printhead or element substrate via the head driver.

The operation of the control arrangement will be described. When a print signal is input to the interface 1700, the print signal is converted into print data for printing between the gate array 1704 and the MPU 1701. The motor drivers 1706 and 1707 are driven. In addition, the printhead IJH is driven in accordance with the print data sent to the head driver 1705 so that printing is executed.

(Printhead)

The ink jet printhead will be described next.

Figure 5B:
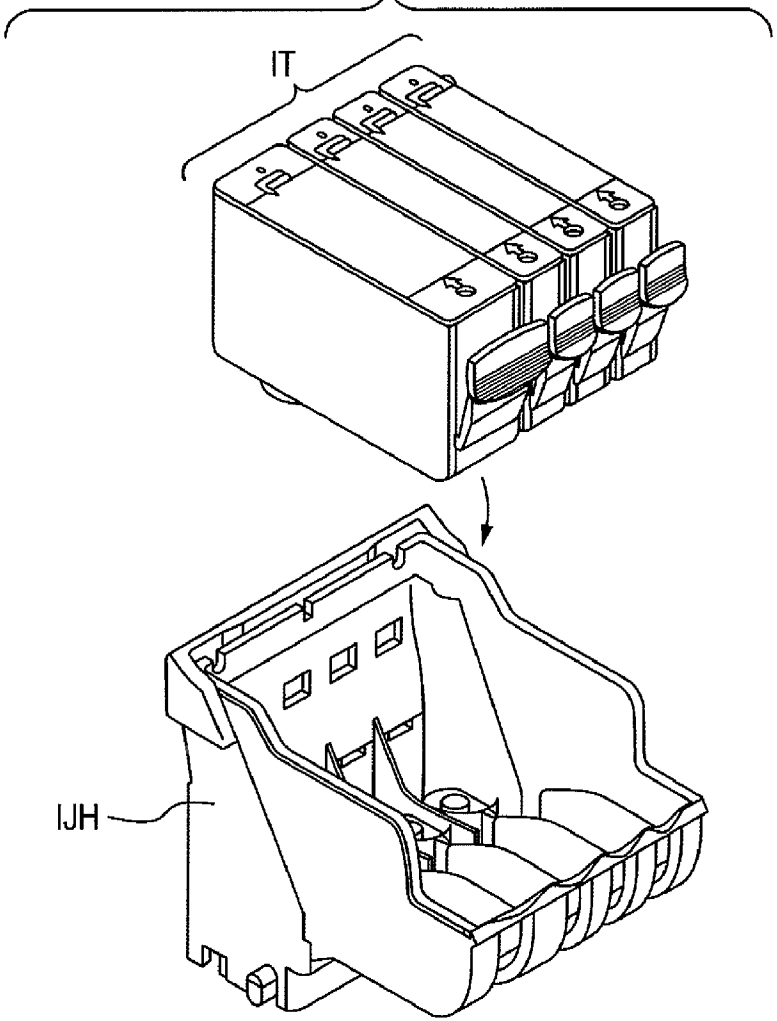
FIG. 5B is a view for explaining integrating an ink tank with an ink jet printhead.
Figure 5A:
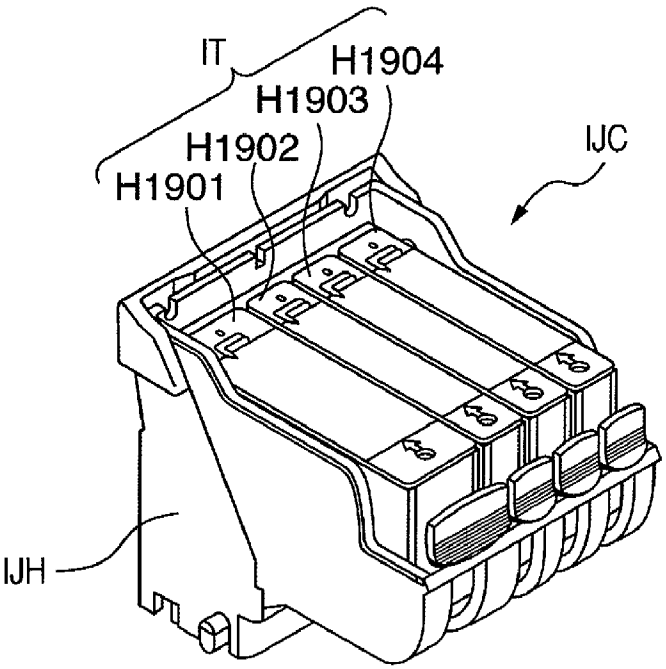
FIG. 5A is a perspective view of a general ink jet printhead.

The ink jet printhead IJH of this embodiment is a constituent element of the printhead cartridge IJC, as is apparent from the perspective views in FIGS. 5A and 5B. FIG. 5B is a view for explaining integrating an ink tank with the printhead. The printhead cartridge IJC includes the printhead IJH and the ink tank IT (H1901, H1902, H1903, and H1904) detachable from the printhead IJH. The printhead IJH discharges ink (print liquid) supplied from the ink tank IT from discharge orifices in accordance with print information.

The positioning means and electrical contacts of the carriage HC which is mounted on the main body of the ink jet printing apparatus IJRA fix and support the printhead cartridge IJC. The printhead cartridge IJC is detachable from the carriage HC.

Figure 6:
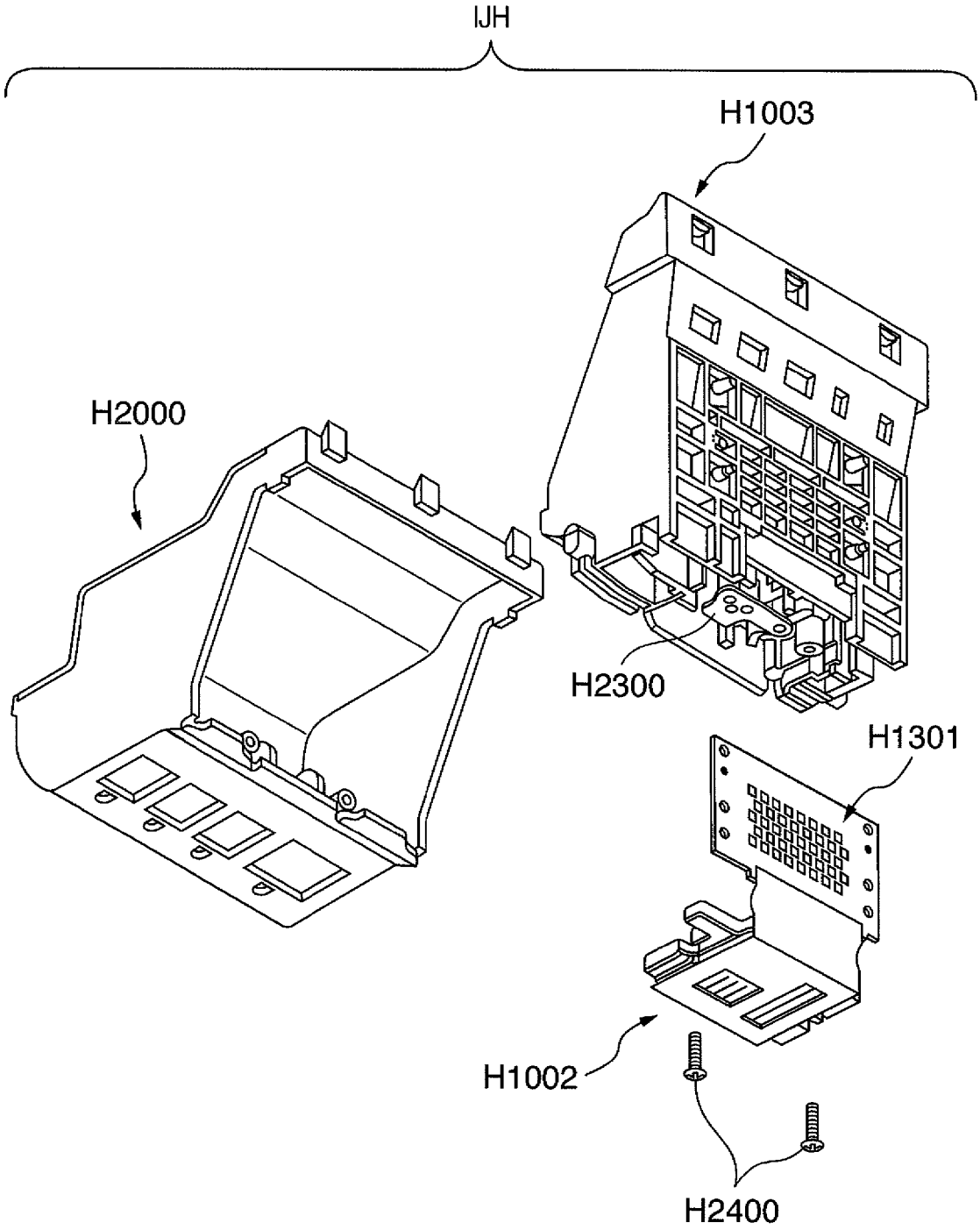
FIG. 6 is a perspective view of a general ink jet printhead.

As is apparent from the exploded perspective view in FIG. 6, the printhead IJH includes a printing element unit H1002, an ink supply unit H1003, and a tank holder H2000. Note that the printhead IJH must communicate the ink communication ports of the printing element unit H1002 with those of the ink supply unit H1003 without leaking ink. To do this, screws H2400 fix the members via a joint seal member H2300 by pressure bonding.

Figure 7:
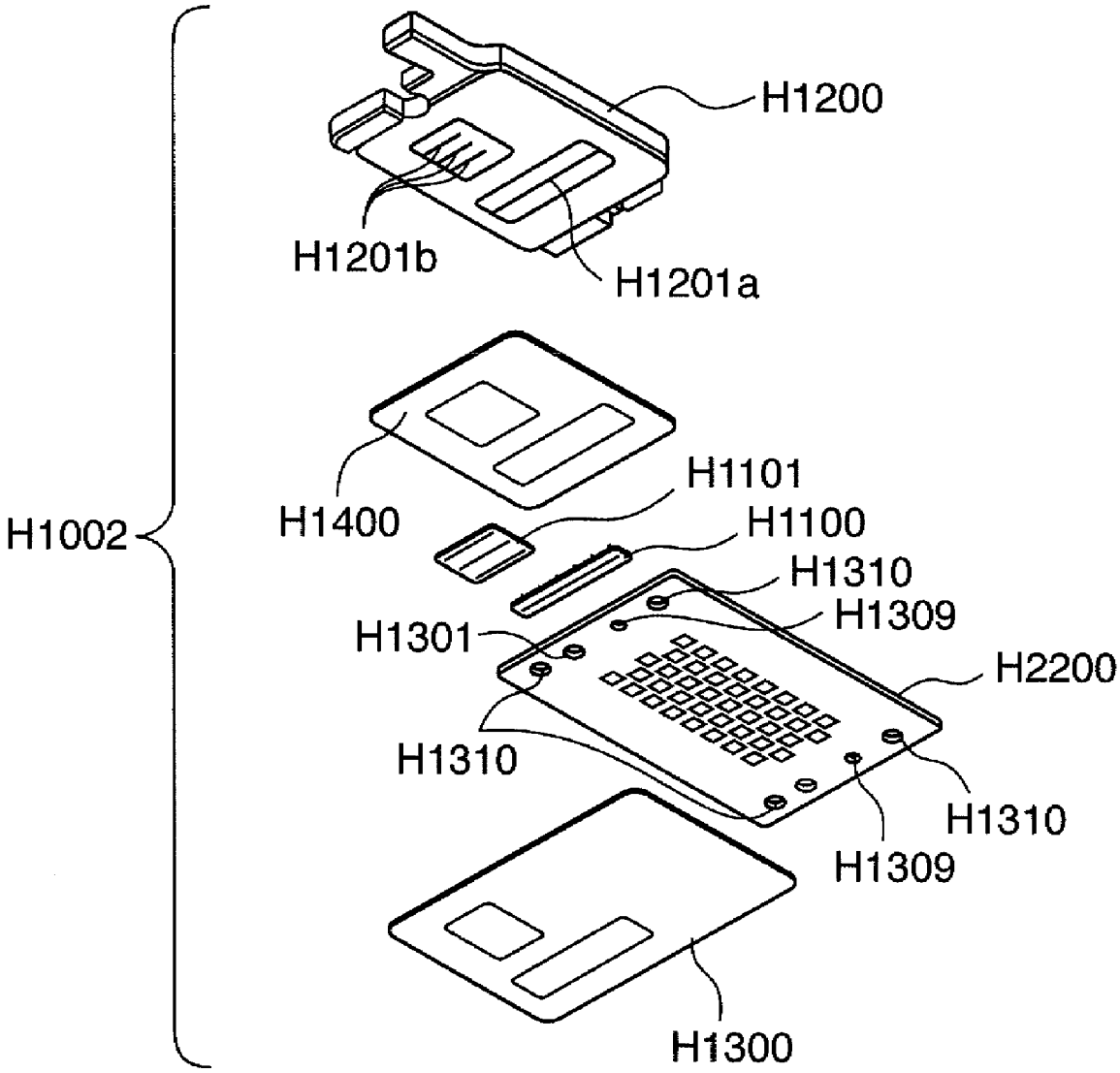
FIG. 7 is a perspective view of a general ink jet printhead.

As is apparent from the exploded perspective view in FIG. 7, a first element substrate H1100 for discharging black ink is bonded and fixed to a first plate H1200. A second plate H1400 having opening portions is bonded and fixed to the first plate H1200. A wiring tape H1300 is bonded and fixed to the second plate H1400 by the TAB method so that the second plate H1400 is aligned with the first element substrate H1100. The wiring tape H1300 applies an electrical signal for ink discharge to the first element substrate H1100 and includes wirings corresponding to the first element substrate H1100. The wiring tape H1300 is connected to an electric contact substrate H2200 having an external signal input terminal H1301 for receiving an electrical signal from the ink jet printing apparatus main body. The electric contact substrate H2200 is aligned and fixed to the ink supply unit H1003 by terminal positioning holes H1309 (at two points). Note that H1201*a* denotes a discharge orifice for discharging black ink, H1201*b* denotes discharge orifices for discharging color inks and H1310 denotes positioning holes other than the holes H1309. Such positioning holes may be provided in the present embodiment.

Figure 8:
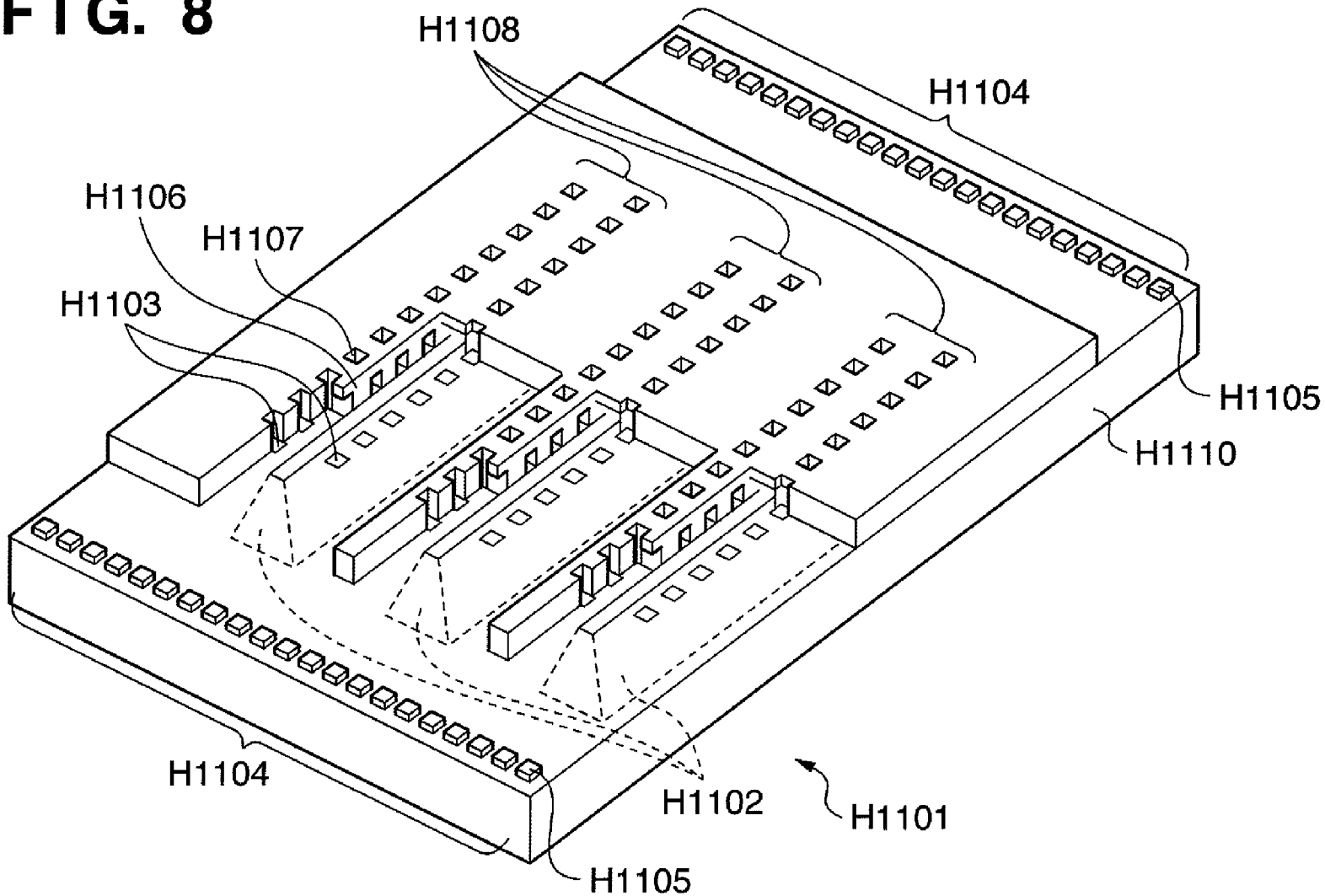
FIG. 8 is a partially cutaway perspective view of an element substrate.

FIG. 8 is a partial cutaway perspective view for explaining the arrangement of a second element substrate H1101. The second element substrate H1101 is formed by juxtaposing three ink supply ports H1102 for discharging three color inks. Two arrays of heaters H1103 and discharge orifices H1107 included in printing elements are arranged (staggered with each other) on both sides of each ink supply port H1102. H1108 denotes arrays of discharge orifices H1107. Wirings, fuses, heaters, electrode portions, and input terminals to input a driving mode selection signal (to be described later), print data, and time division control data are formed on an Si substrate H1110. Ink channel walls H1106 made of a resin material and the discharge orifices H1107 included in the printing elements are also formed on the Si substrate H1110 by photolithography. Bumps H1105 made of, for example, Au are formed on electrode portions H1104 and supply power to the wirings.

(Head Cartridge)

Figure 10:
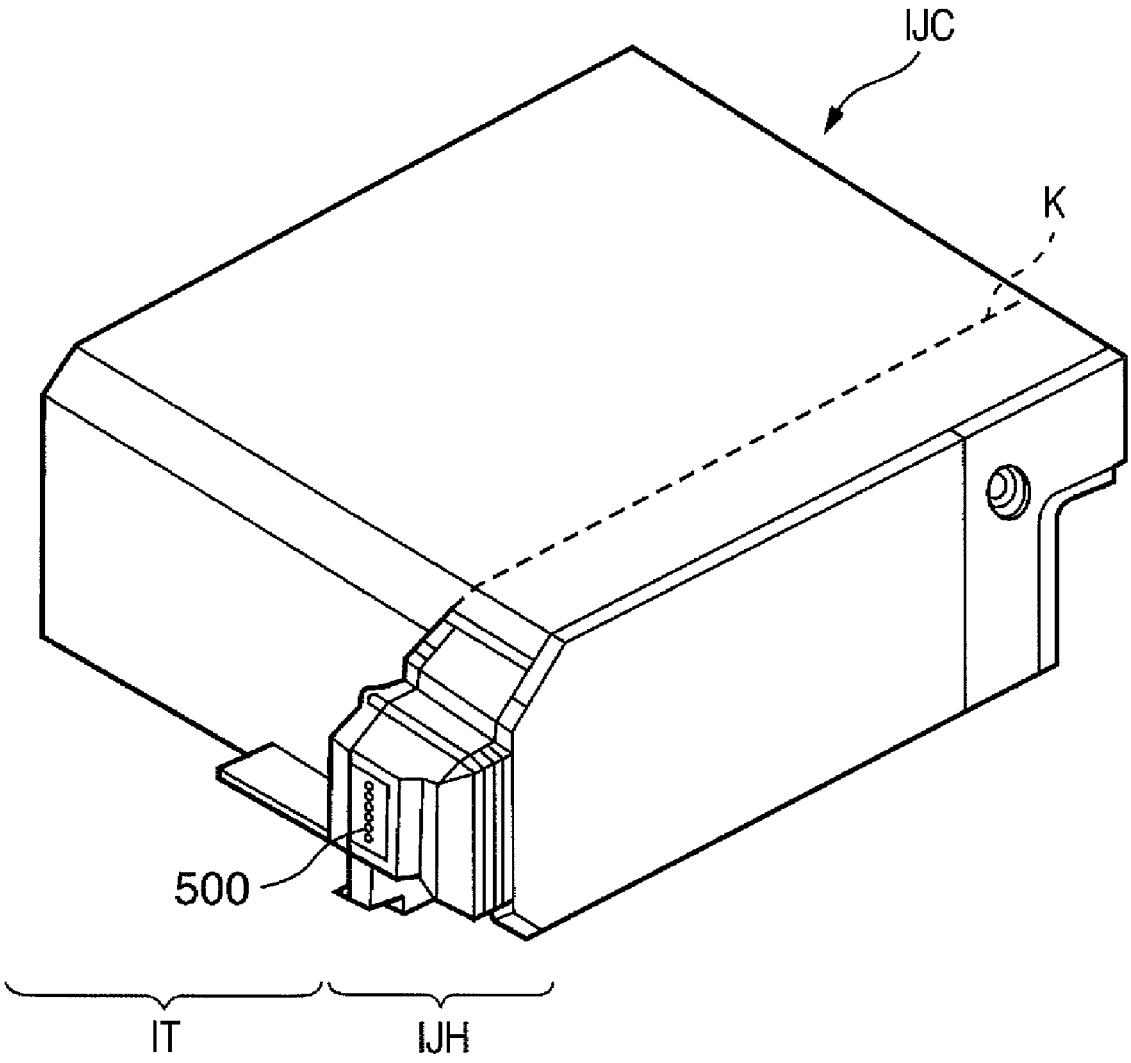
FIG. 10 is a perspective view of a general head cartridge.

FIG. 10 is an outer perspective view showing the arrangement of the head cartridge IJC in which the ink tank and the printhead are integrated. Referring to FIG. 10, a dotted line K indicates the boundary between the ink tank IT and the printhead IJH. The head cartridge IJC has an electrode (not shown) for receiving an electrical signal supplied from the side of the carriage HC when the head cartridge is mounted on the carriage HC. The electrical signal drives the printhead IJH to discharge ink, as described above.

Referring to FIG. 10, reference numeral 500 denotes an ink discharge orifice array.

The ink jet print substrate H1101 that is the gist of the present invention will be described next in detail with reference to FIGS. 1 to 3.

(First Embodiment)

Figure 2A:
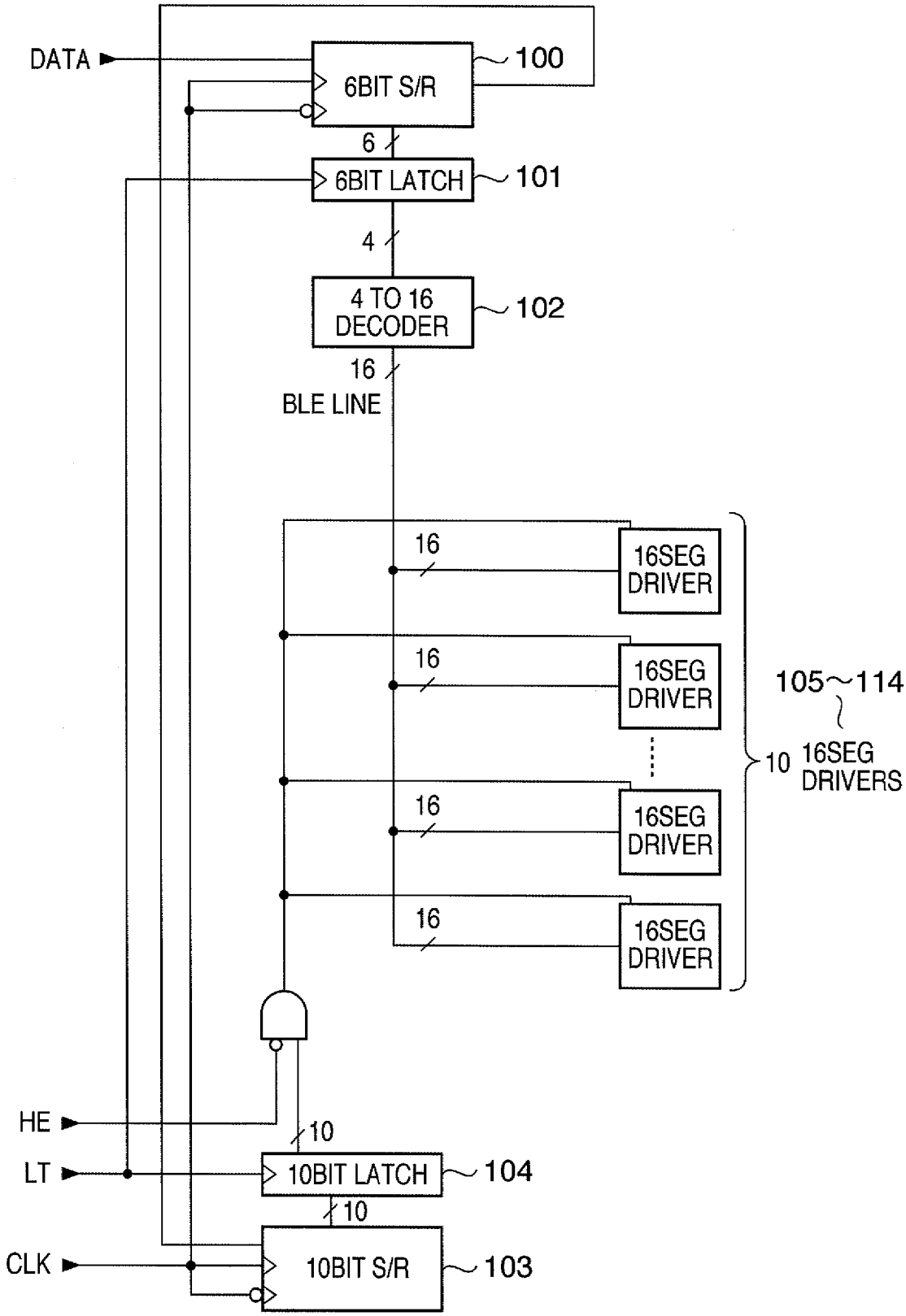
FIG. 2A is a block diagram showing the schematic arrangement in a general element substrate.

FIG. 2A is a block diagram showing an example of the schematic circuit arrangement in a general ink jet printhead element substrate. FIG. 2A shows the arrangement for one printing element array. When a printhead includes a plurality of printing element arrays, the arrangements exist equal in number to the printing element arrays. In the example shown in FIG. 2A, each printing element array includes 160 printing elements. It is necessary to prevent discharge power down caused by simultaneous ink discharge from adjacent or neighboring printing elements and execute stable ink discharge for printing. For this purpose, the printing elements are divided into 16 blocks, each including 10 printing elements (segments) that are simultaneously drivable in accordance with print data so that time division distributed driving can be performed.

Each printing element has a heater and a discharge orifice for ink discharge.

A 6-bit shift register 100 in FIG. 2A shifts data (DATA) input in accordance with a clock signal (CLK). A 6-bit latch 101 latches, at a timing defined by a latch signal (LT), the block control data stored in the 6-bit shift register 100. A decoder 102, serving as a block selection circuit, decodes, of the block control data latched by the 6-bit latch 101, four signal bits (except for reserve bits) and outputs a block selection signal. The block selection signal output from the decoder 102 determines which one of the 16 blocks should be driven. A 10-bit shift register 103 receives print data shifted via the 6-bit shift register 100.

A 10-bit latch 104 latches, at a timing defined by the signal LT, the print data stored in the 10-bit shift register 103. Driver units (16SEG DRIVER) 105 to 114 include as many driving elements (drivers) as the segments. The driving elements are provided in the printing elements and selectively drive the heaters. Each driver unit includes, for example, AND circuits (not shown) each of which ANDs the block selection signal and the print data signal and outputs a signal to the driving elements of heaters. In FIG. 2A, 10 drivers each corresponding to 16 segments (SEG) are present. A printing element to be driven is determined by the block selection signal output from the decoder 102 and the image data output from the 10-bit latch 104. When a driver serving as a switching transistor is turned on for a time (pulse width) defined by a heat enable signal (HE) as a driving signal, corresponding heaters are driven.

One image signal bit output from the 10-bit latch 104 is commonly input to the 16 AND circuits included in one driver unit. A driver unit may be called a group. Heaters in one group are divided into 16 blocks and time-divisionally driven. Hence, the heaters are never selected and driven simultaneously in normal printing. The element substrate of the present invention has a plurality of groups. The element substrate of this embodiment has 10 groups.

Figure 2B:
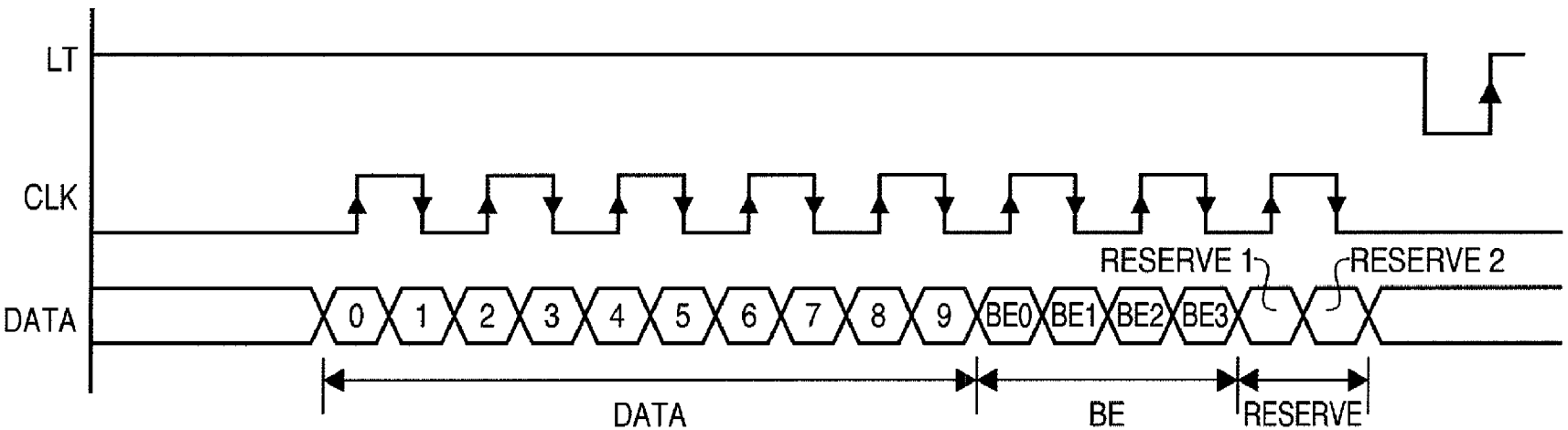
FIG. 2B is a timing chart of signals associated with data transfer in the general element substrate.

FIG. 2B is a timing chart showing an example of signals associated with data transfer to the printhead having the above-described arrangement.

In this example, LT is a signal of LOW (L): through, and HIGH (H): active. Only when the signal LT is H, the latches 101 and 104 latch DATA. DATA is transferred serially in synchronism with CLK, as shown in FIG. 2B. In this example, DATA is transferred at both timings of the leading edge and trailing edge of CLK. DATA of one block contains 16 bits corresponding to one printing element array and is transferred at the timing shown in FIG. 2B. DATA0 to DATA9 indicate print data, and BE0 to BE3 indicate block control data.

With this control method, print data corresponding to all driver units are transferred together with block control data, and the drive timing is set for each block. This enables printhead driving (ink discharge) of one step. Printing corresponding to all printing elements can be done by repeating this process as many times as the number of blocks.

Figure 9:
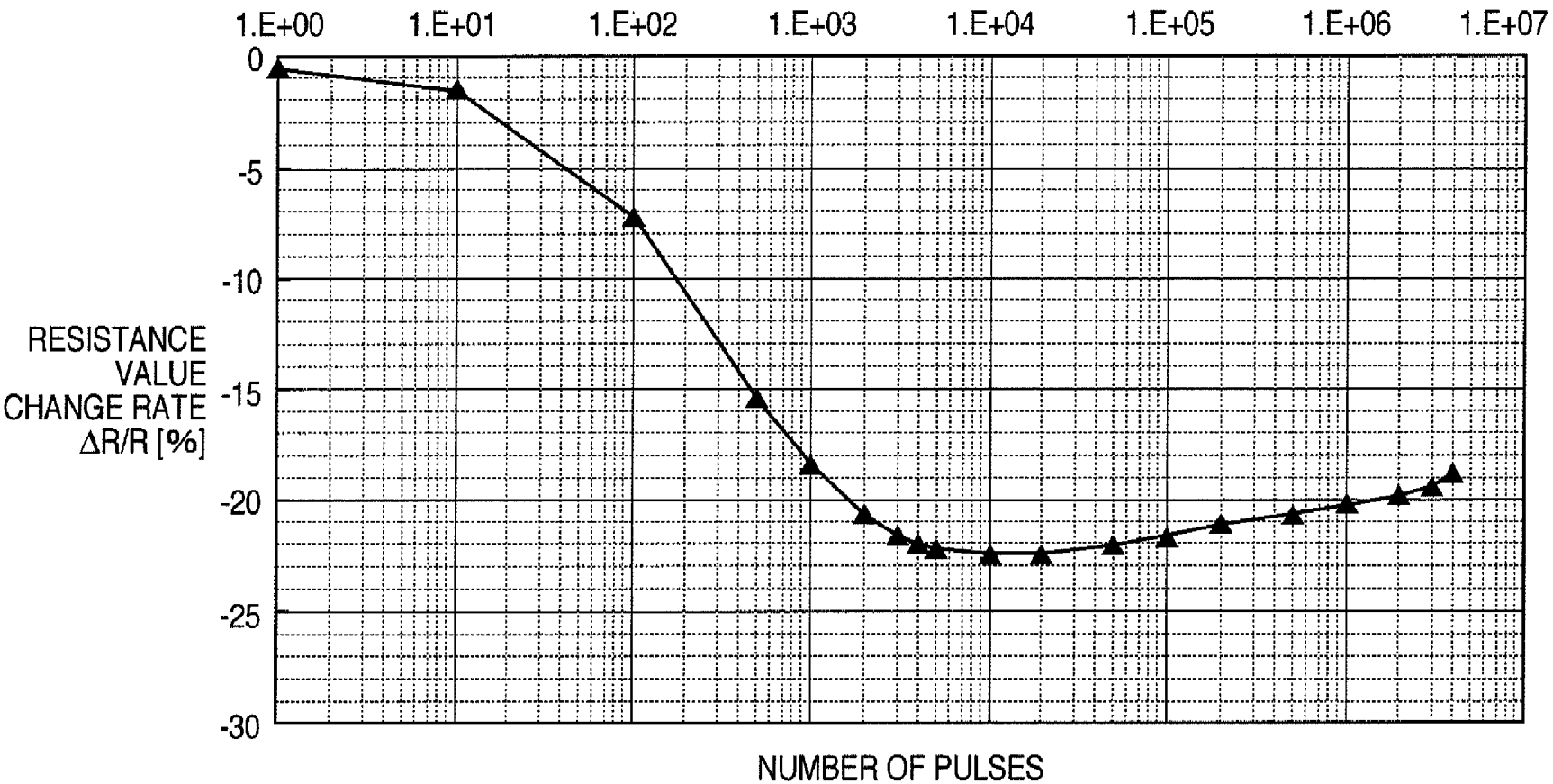
FIG. 9 is a graph showing a change in the resistance value caused by applying a short pulse to a heater using CrSiN.

However, to execute printing at a higher speed and higher image quality as will be required in the future, as described above, it is necessary to stabilize discharge by suppressing temperature rise of the printhead without lowering the driving voltage. More specifically, high-speed, high-quality printing can be done by forming an image by, for example, discharging ink droplets in an amount of 1 pl or less from many printing elements at a high driving frequency. To implement this, a heater using a CrSiN film as a heater material has been proposed. However, the resistance value of CrSiN film when a voltage having a pulse width in actual printing is applied about $1.0\times10^4$ times, as shown in FIG. 9. Finally, excess power may be applied to the heater, resulting in a discharge error or break.

To prevent this, a heater resistance value stabilization process is executed before actual printing (more specifically, a pulse is applied about $1.0\times10^4$ times). Printing is performed after the resistance value change has stabilized. A case in which an annealing process is used as the heater resistance value stabilization process will be described below. In this specification, an annealing process indicates a process of heating a heater to a predetermined temperature or more for a predetermined long time, thereby stabilizing the heater. This is a process of, for example, continuously applying a driving signal for heater driving to a heater about $1.0\times10^4$ times so that the heater is kept at 400° C. to 700° C. for a period longer than the heater driving period in a printing operation.

Figure 14A:
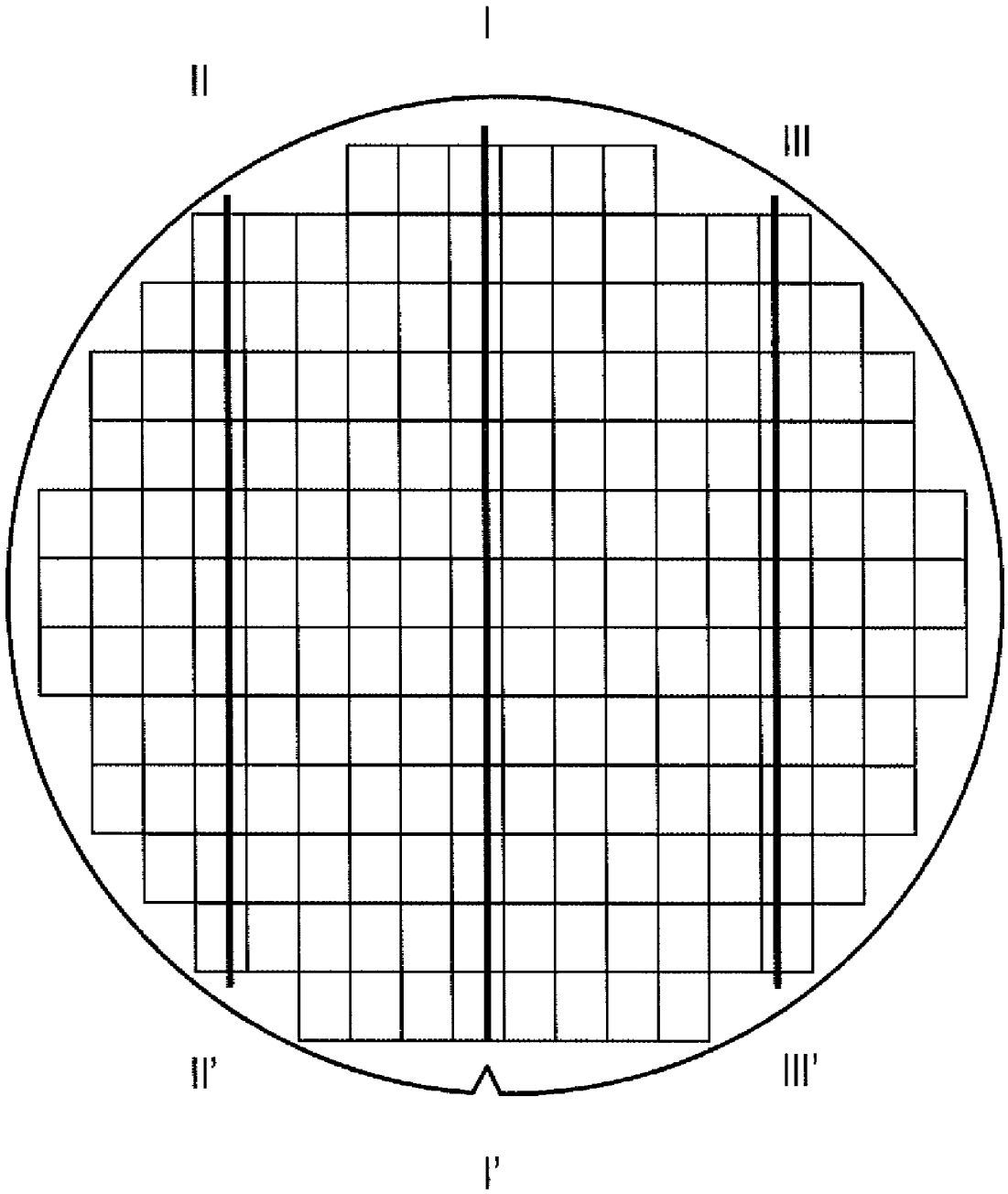
FIG. 14A is an explanatory view of a 6- or 8-inch Si substrate and chips.
Figure 14B:
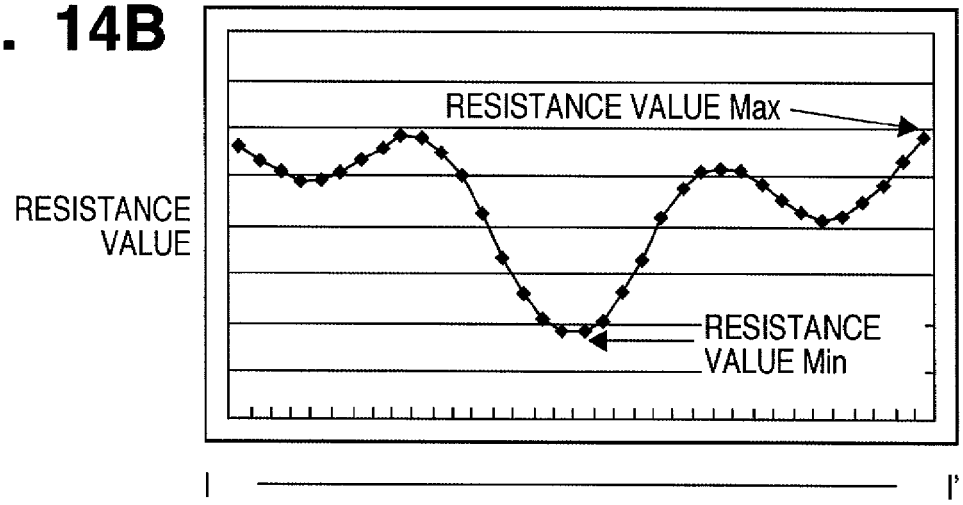
FIG. 14B is an explanatory view of the resistance value distribution of heaters on a section taken along a line I-I'.
Figure 14C:
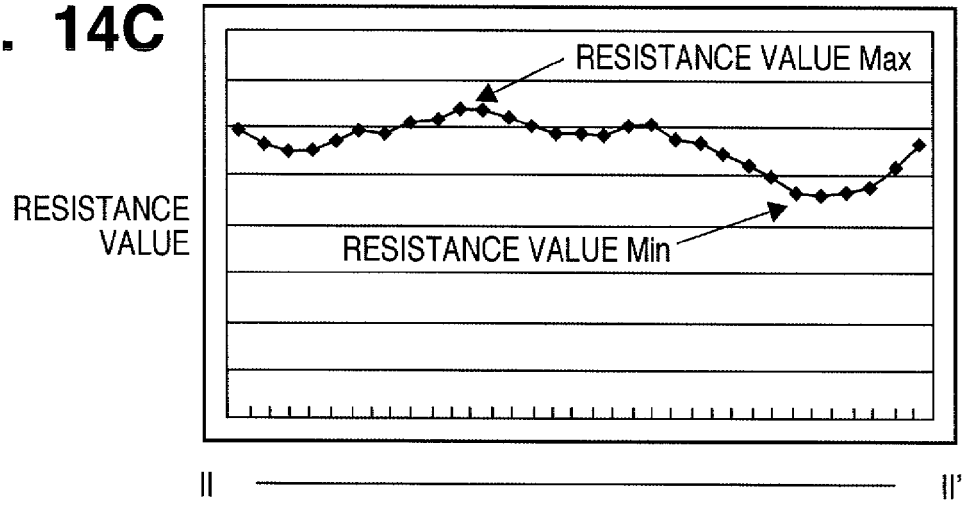
FIG. 14C is an explanatory view of the resistance value distribution of heaters on a section taken along a line II-II'.
Figure 14D:
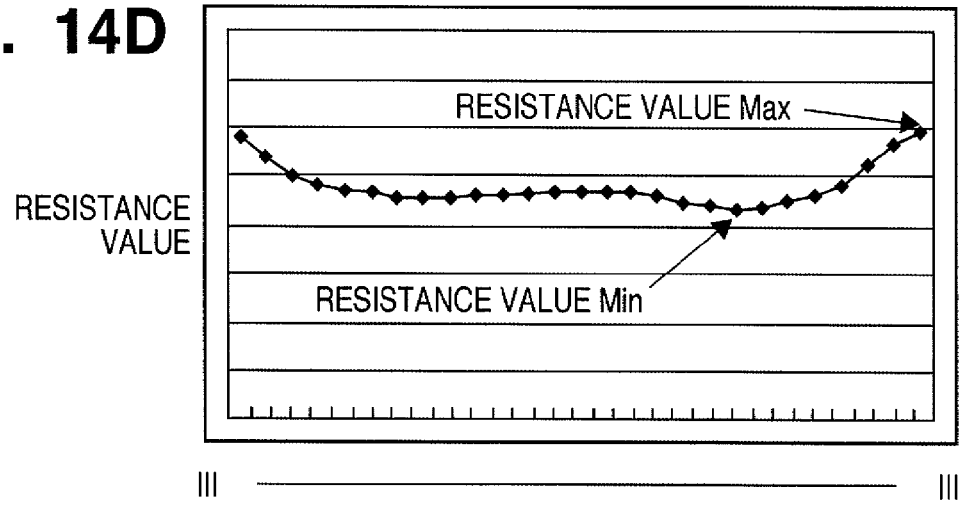
FIG. 14D is an explanatory view of the resistance value distribution of heaters on a section taken along a line III-III'.

In this case, the annealing process must be performed for all segments. However, fine annealing process control according to the variation between the printing element (nozzle) arrays in the chip may be impossible. FIG. 14A shows a state in which chips are arranged on an Si substrate. The Si substrate is straight-cut along the lines I-I', II-II', and III-III' viewed from the upper side. FIGS. 14B, 14C, and 14D are graphs of heater resistance values along the straight-cut lines. According to these graphs, the resistance value distribution is large at the I-I' portion obtained by straight-cutting the central portion of the substrate, as shown in FIG. 14B. As shown in FIGS. 14C and 14D, at the II-II' and III-III' portions, the distribution is smaller than that at the I-I' portion in FIG. 14B. As can be seen by specifically examining the graph of the I-I' portion, the distribution includes regions having steep gradients (tilts) and regions having relatively flat gradients. That is, areas where the resistance value distribution of heaters is large and areas where the distribution is small simultaneously exist in a single chip. It is therefore important to execute an appropriate annealing process for each area. This problem can be solved by executing the annealing process sequentially for each printing element. However, this is not realistic from the viewpoint of productivity because the annealing process time increases. This embodiment solves the problem by the following arrangement.

Figure 3A:
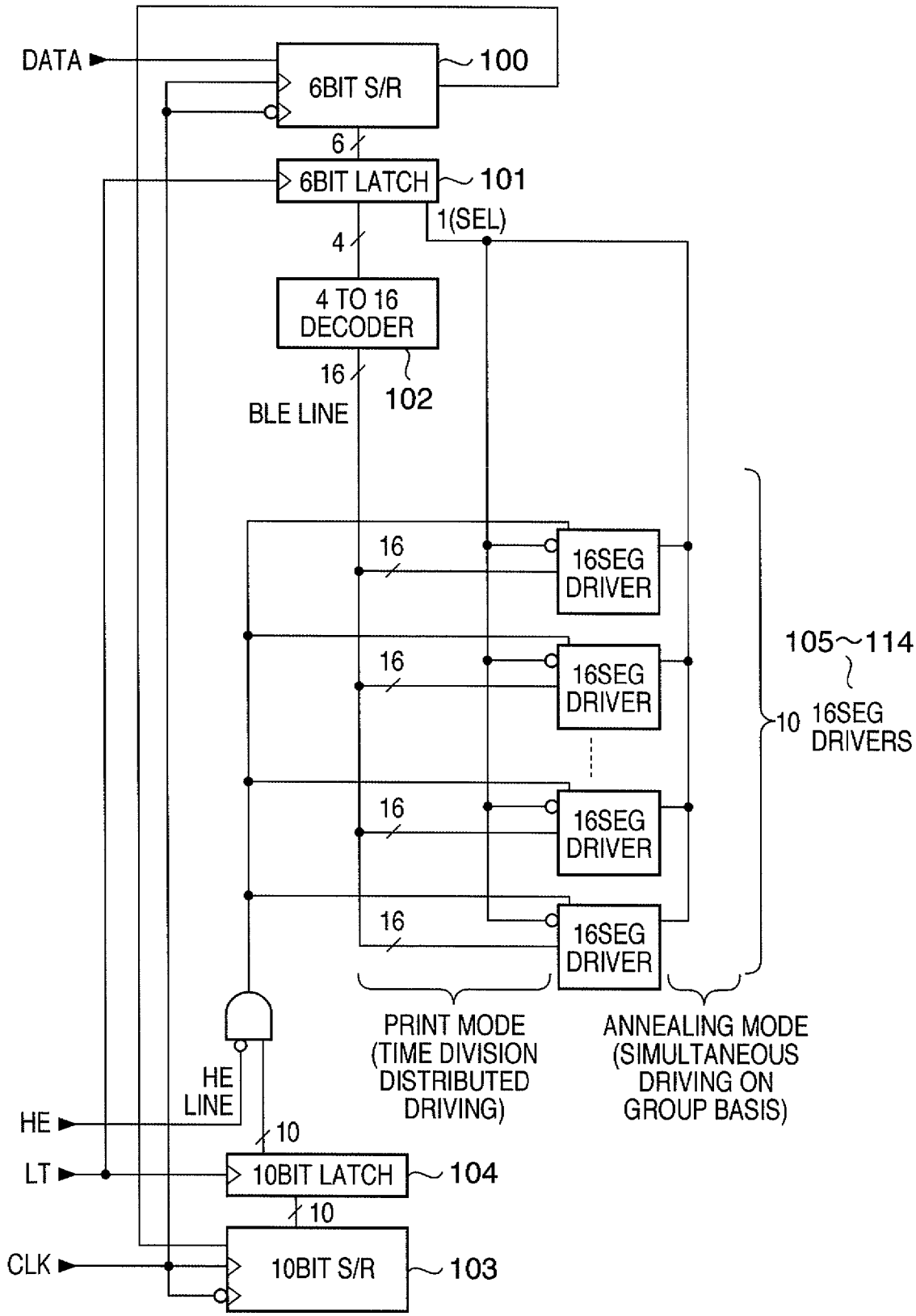
FIG. 3A is a block diagram showing the schematic arrangement in an element substrate according to the first embodiment.

FIG. 3A is a block diagram showing an example of the schematic circuit arrangement in the ink jet printhead element substrate according to this embodiment. FIG. 3A shows the arrangement for one printing element array. When a printhead includes a plurality of printing element arrays, the arrangements exist equal in number to the printing element arrays. FIG. 3A shows a circuit arrangement capable of time division driving, like the general ink jet printhead element substrate shown in FIG. 2A.

In FIG. 2A, decoding is performed using a 4-bit signal. In this embodiment, a driving mode selection signal (SEL) that is a 1-bit signal is additionally used. The 6-bit latch 101 serving as a logic circuit outputs SEL to a signal line commonly connected to the driver units to determine the driving mode of each driver unit. In this embodiment, when SEL is LOW (L), a time division driving method that is a normal print mode (first driving mode) is employed. When SEL is HIGH (H), an annealing process mode (second driving mode) is employed to simultaneously drive all heaters in each group. The logic combination is not limited to that shown in FIG. 3A. In this embodiment, the block selection signal after decoding is used not in the annealing process mode but only in the print mode.

Figure 1:
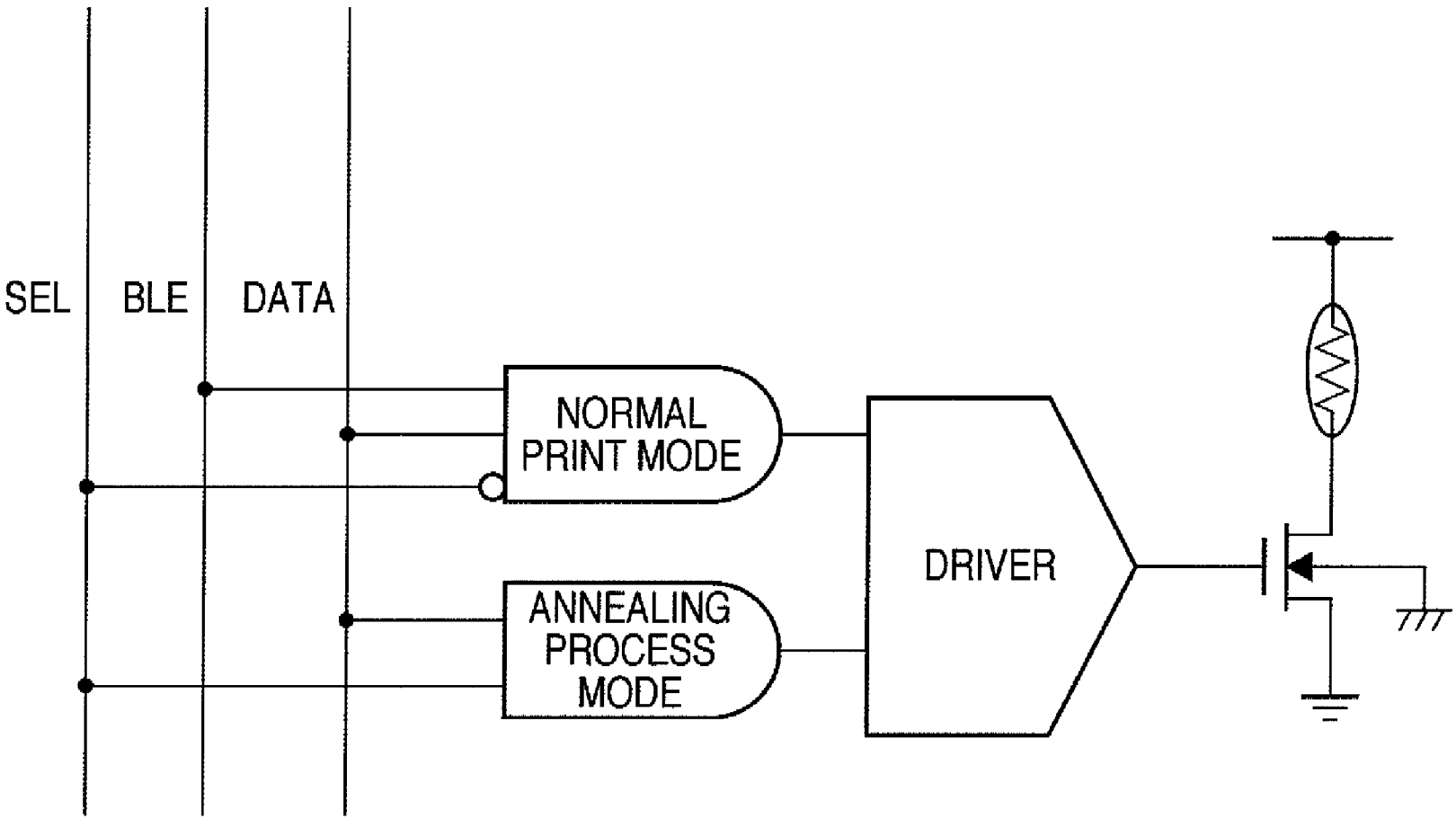
FIG. 1 is an equivalent circuit diagram for explaining the driving logic of an element substrate according to an embodiment.

FIG. 1 shows a 1-bit driver (driving element) that is included in the driver unit of the embodiment and corresponds to one heater. FIG. 1 also shows a logic circuit (AND circuit in this embodiment) which receives the driving mode selection signal (SEL), block selection signal (BLE), and print data signal (DATA) and outputs a signal to be supplied to the driver. As shown in FIG. 1, the block selection signal (BLE) output from the decoder 102 and DATA output from the 10-bit latch 104 in FIG. 3A determine a heater to be driven in normal printing. The heater is driven for a time defined by HE.

Figure 3B:
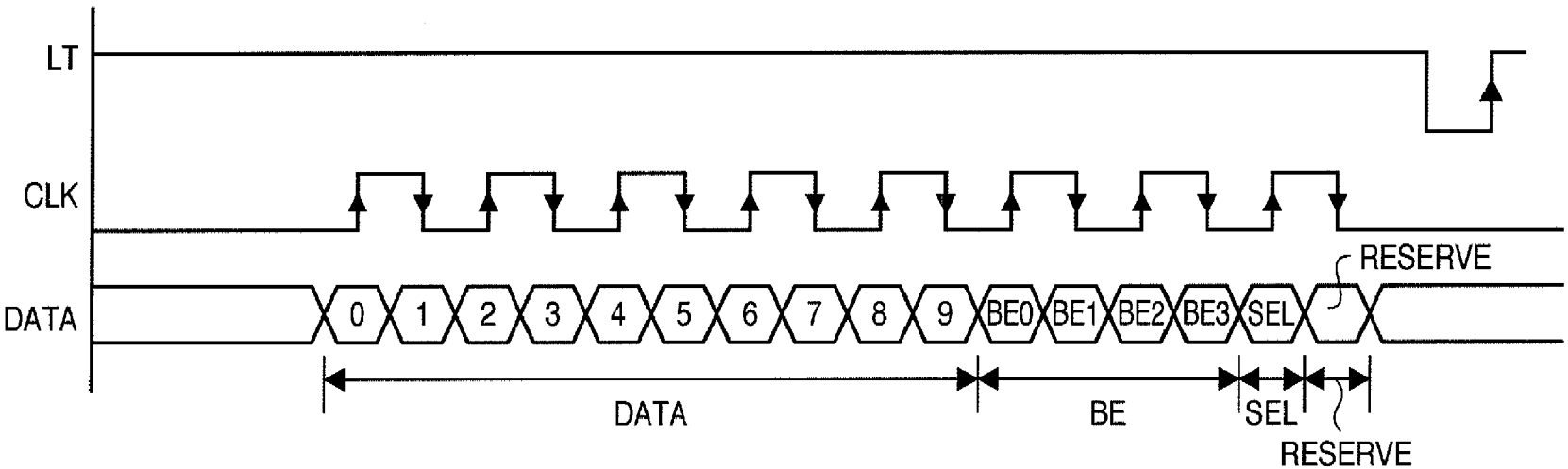
FIG. 3B is a timing chart of signals associated with data transfer according to the first embodiment.

The DATA signal line has the arrangement shown in FIG. 1 and is used both in normal printing and in the annealing process. FIG. 3B is a timing chart showing an example of the timings of signals associated with data transfer to the printhead. Of the DATA signal shown in FIG. 3B, DATA0 to DATA9 indicate print data, and BE0 to BE3 indicate block control data. SEL next to the DATA signal is data for selecting an annealing target driver unit from the plurality of driver units. In the annealing process, the 6-bit latch 101 in FIG. 3A changes SEL to H, and desired DATA is supplied via the 10-bit latch, as shown in FIG. 1. The annealing target driver unit is selected in this way, and the annealing process is executed by driving the heater for a time defined by HE.

Switching between the normal print mode (first driving mode) and the annealing process mode (second driving mode) is done by a switching circuit such as an XOR circuit or a multiplexer arranged at the preceding stage of the driver gate.

With this control method, data corresponding to all driver units are transferred together with block control data, and the drive timing is set for each block. This enables the annealing process and printhead driving in normal printing. Additionally, SEL switches between the annealing process mode and the print mode. For this reason, the driven segment selection logic in the print mode and that in the annealing process mode are exclusive logics, and exclusive driving for each mode is also possible.

The heater used in the present invention will be described next. In this embodiment, the heater is formed by reactive sputtering using an alloy target of Cr and Si. A CrSiN thin film (a film made of Cr, Si, and N) immediately after film formation by this forming method is generally a thin film having an amorphous structure. When a CrSiN film having an amorphous structure with a high resistance is annealed at 400° C. to 700° C., a CrSi microcrystal having a low resistance is formed. This stabilizes the structure of the thin film, as is known.

(Second Embodiment)

Figure 4:
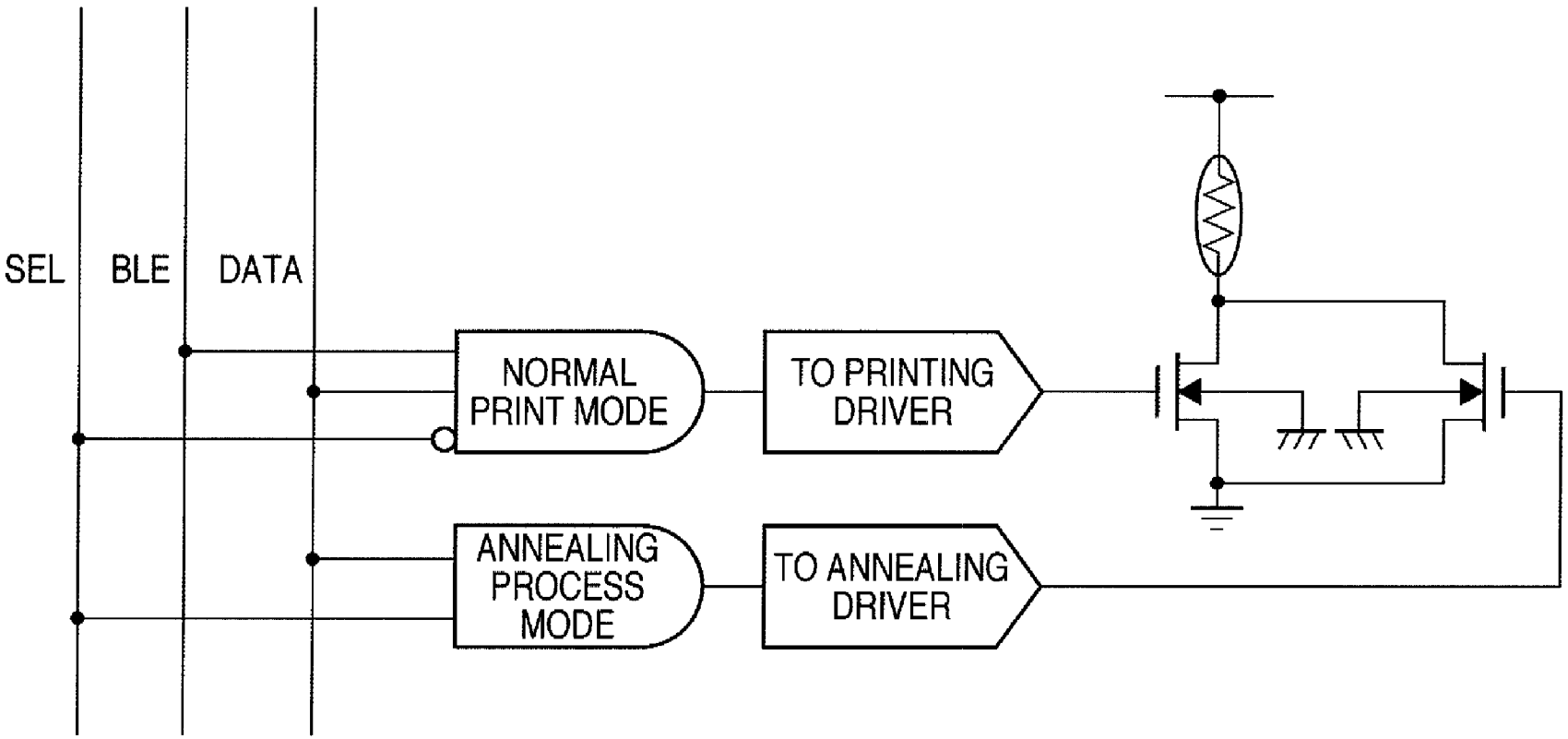
FIG. 4 is an equivalent circuit diagram for explaining the driving logic of an element substrate according to the second embodiment.

Another embodiment of the present invention will be described next with reference to FIG. 4. In this embodiment, shift registers and latches are used, as in the first embodiment, although not illustrated. In the first embodiment, one driver corresponding to heaters is driven using the logic circuit as shown in FIG. 1. As a characteristic feature of the second embodiment, annealing drivers (second driving elements) for executing a batch annealing process of heaters in each group corresponding to a driver unit are separately arranged for the respective segments. Additionally, the printing drivers and annealing drivers share the same source. This allows for arrangement of a plurality of drivers without greatly increasing the size.

In normal driving, the normal printing drivers (first driving elements) are used as driving elements to execute time division distributed driving. The annealing process is performed using the drivers (second driving elements) which are separately arranged and simultaneously turned on in each group. The driven segment selection logic in the print mode and that in the annealing process mode are exclusive logics, and exclusive driving is necessary for each mode, as described above. The above-described arrangement enables execution of time division distributed driving in normal printing, and simultaneous turning on of the driving elements in each block group in the annealing process.

The embodiments of the present invention have been described above. The embodiments can appropriately be combined in accordance with the chip size and layout.

The printing apparatus according to the present invention may take not only the form of an integrated or separate image output terminal of an information processing device such as a computer but also the form of a copying apparatus combined with a reader or the like, or the form of a facsimile apparatus having a transmission and reception function.

The above embodiments have been described by exemplifying an element substrate for an ink jet printhead. However, the embodiments are also applicable to an element substrate for a printhead using a thermal transfer method or a printhead of sublimation type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-143788, filed May 30, 2007, and 2008-131275, filed May 19, 2008 which are hereby incorporated by reference herein in their entirety.

What is claimed is:

1. A substrate for an ink jet printhead comprising:

a plurality of heaters that are used for generating energy for ink droplet discharge, wherein the plurality of heaters are divided into a plurality of groups;

a plurality of switching elements each corresponding to each of the heaters and configured to determine an energization of each heater; and a plurality of logic circuits each corresponding to each of the switching elements, each of the logic circuits outputs a drive signal to each switching element for determining the energization of each heater;

a print data circuit that outputs a print data signal to the plurality of logic circuits, wherein the same print data signal is input to the logic circuits corresponding to one group;

a block selection circuit that outputs block selection signal to the plurality of logic circuits, for time-divisionally driving each of heaters in a group in different timings; and a selection circuit that outputs the same selection signal to all of the logic circuits, wherein the selection circuit outputs the selection signal which is HIGH in an annealing process mode and outputs the selection signal which is LOW in a normal print mode, and wherein each of the logic circuits includes:

a first driver circuit that calculates a logical product of the print data signal, the block selection signal and inversion signal of the selection signal; and a second driver circuit that calculates a logical product of the print data signal and the selection signal.

2. The substrate according to claim 1, wherein a material of the heaters is an amorphous material made of Cr, Si, and N.

3. An ink jet printhead including the substrate according to claim 1.

4. The substrate according to claim 1, wherein the heaters are formed by sputtering a material.

5. The substrate according to claim 1, wherein if the selection signal output from the selection circuit is LOW, a signal output from the first driver circuit is output as the driving signal, and if the selection signal output from the selection circuit is HIGH, a signal output from the second driver circuit is output as the driving signal.

* * * * *